US007771009B2

(12) United States Patent
Takatsuka

(10) Patent No.: US 7,771,009 B2
(45) Date of Patent: Aug. 10, 2010

(54) IMAGE RECORDING APPARATUS

(75) Inventor: Tsutomu Takatsuka, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 1168 days.

(21) Appl. No.: 10/946,487

(22) Filed: Sep. 22, 2004

(65) Prior Publication Data

US 2005/0063666 A1 Mar. 24, 2005

(30) Foreign Application Priority Data

Sep. 22, 2003 (JP) ..... 2003-330324

(51) Int. Cl.
*B41J 2/15* (2006.01)

(52) U.S. Cl. ..... 347/40; 347/42

(58) Field of Classification Search ..... 347/13
See application file for complete search history.

(56) References Cited

U.S. PATENT DOCUMENTS

| | | | | |
|---|---|---|---|---|
| 5,668,581 | A | 9/1997 | Tsuji et al. | |
| 6,089,693 | A | 7/2000 | Drake et al. | |
| 6,308,041 | B2 * | 10/2001 | Shiramura | 399/410 |
| 6,406,118 | B1 * | 6/2002 | Aoki et al. | 347/16 |
| 6,454,392 | B1 * | 9/2002 | Lopez et al. | 347/43 |
| 6,481,820 | B1 | 11/2002 | Tamura et al. | |
| 6,679,597 | B2 * | 1/2004 | Ohsawa et al. | 347/95 |
| 7,085,002 | B2 * | 8/2006 | Ilbery et al. | 358/1.8 |
| 2001/0050017 | A1 * | 12/2001 | Ohsawa et al. | 101/465 |
| 2002/0044185 | A1 * | 4/2002 | Koitabashi et al. | 347/98 |
| 2005/0063666 | A1 * | 3/2005 | Takatsuka | 386/46 |

FOREIGN PATENT DOCUMENTS

| | | | |
|---|---|---|---|
| JP | 7-117297 | A | 5/1995 |
| JP | 9-24627 | A | 1/1997 |
| JP | 09272227 | A * | 10/1997 |
| JP | 11-245396 | A | 9/1999 |
| JP | 11-334047 | A | 12/1999 |
| JP | 2002-1936 | A | 1/2002 |
| JP | 2002103638 | A * | 4/2002 |

OTHER PUBLICATIONS

Shinya et al. (Publication No. JP 2002-103638).*

* cited by examiner

*Primary Examiner*—Stephen D Meier
*Assistant Examiner*—Alexander C Witkowski
(74) *Attorney, Agent, or Firm*—Birch, Stewart, Kolasch & Birch, LLP

(57) ABSTRACT

The image recording apparatus for recording images to a recording medium comprises a recording head arrangement device for arranging the line recording head so that at least the lengthwise direction of the line recording head is in an orthogonal position substantially orthogonal to the conveyance direction of the recording medium, or the lengthwise direction of the line recording head is in a parallel position substantially parallel to the conveyance direction of the recording medium; and a shuttle scan mechanism for causing the line recording head to shuttle-scan in the direction substantially orthogonal to the conveyance direction while the parallel position is maintained, wherein the line recording head records images as a line head when arranged in the orthogonal position, and records images by shuttle scanning when arranged in the parallel position.

6 Claims, 7 Drawing Sheets

FIG.5A
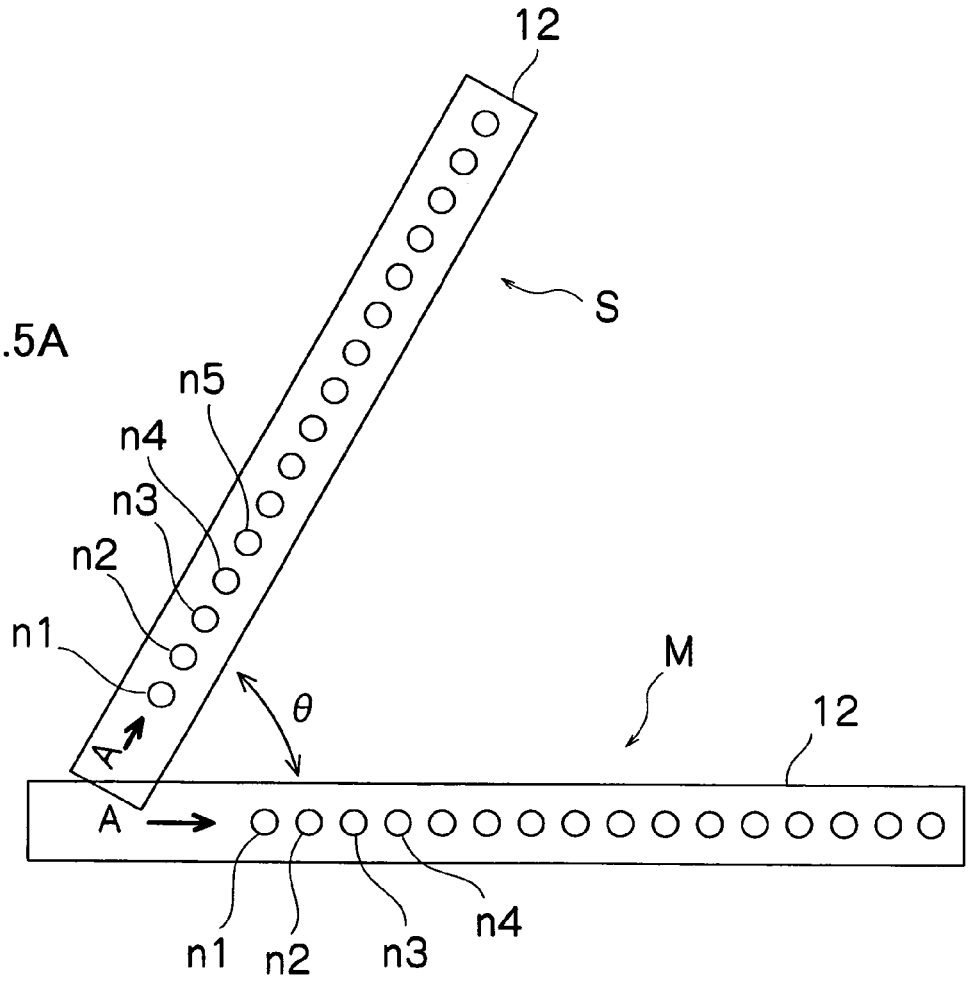
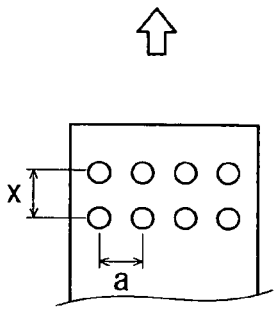
FIG.5B
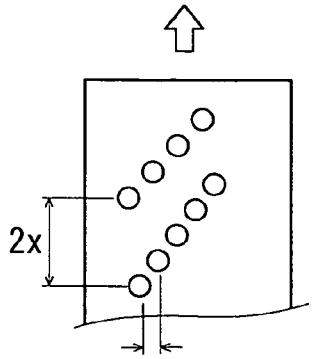
FIG.5C
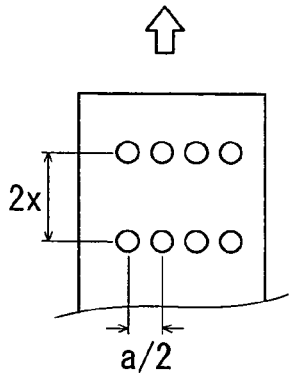
FIG.5D

IMAGE RECORDING APPARATUS

This Nonprovisional application claims priority under 35 U.S.C. §119(a) on Patent Application No(s). 2003-330324 filed in Japan on Sep. 22, 2003, the entire contents of which are hereby incorporated by reference.

BACKGROUND OF THE INVENTION

1. Field of the Invention

The present invention relates to an image recording apparatus, and more particularly to an image recording apparatus that allows recording at a high speed to a recording medium with a plurality of widths using a recording head in which a plurality of image-recording elements are arrayed, and that enables restoration of defective pixels.

2. Description of the Related Art

A known example of an image recording apparatus is an inkjet printer that has an inkjet head (recording head) in which a plurality of nozzles (image-recording elements) are arrayed, and that forms images on a recording medium by discharging ink from the nozzles as the recording head and recording medium are moved relative to each other.

When attempting to obtain a high-quality print in such an inkjet printer, the droplet diameter during ink discharge is preferably made small, and the space between neighboring ink droplets discharged to the surface of the recording medium is preferably made narrower, but the diameter of an ink discharge port is even smaller than the droplet diameter during ink discharge, and the space between neighboring ink discharge ports has substantially reached a limit in terms of ensuring machining accuracy.

Known inventions (Japanese Patent Application Publication No. 2002-1936, for example) devised in response to this problem are designed such that an inkjet head is rotated within the plane parallel to the conveyance plane of the recoding medium, the inkjet head is rotated by a predetermined angle with respect to the conveyance direction, the interval between the ink discharge ports in the inkjet head is reduced in the conveyance direction of the recording medium, and the pixel density in the print is increased by a corresponding amount to obtain a high-quality print.

In the above inkjet printer, ink may not be discharged or discharged ink may not have a proper flight direction due to clogged nozzles in the print head, a soiled meniscus surface on the ink, or other factors, and missing spots may occur during printing for this reason. Such missing spots in printing hardly stand out due to the considerable overlap in the shuttle-scan method, but print defect nonuniformity is marked in the case of a line head.

Known inventions developed in response to this problem include those (Japanese Patent Application Publication No. 11-334047, for example) that have a device for detecting nozzle defects in a line inkjet printer with an inkjet head in which a plurality of nozzles are arrayed with a length corresponding to the width of the recording medium, and that retouch defective pixels when there are defects in the line head nozzles by recording images using an auxiliary head jointly provided to the line head; those related to an image recording apparatus for recording images with the dot matrix method (Japanese Patent Application Publication No. 9-24627, for example) in which the direction of the recorded recording medium is reversed while the medium is moved by a predetermined amount with respect to the recording head in the width direction, and when a printing defect is found, the printing defect is retouched so that dot data to be printed is printed using a normally functioning dot print element at a predetermined distance from the defective dot print element when the recorded recording medium is discharged; and other inventions.

Nevertheless, as cited in Japanese Patent Application Publication No. 2002-1936 above, when the recording head is rotated by a predetermined angle to record images, the apparent image density is increased and a high-quality print can be obtained, but there are drawbacks in that the recording area in the width direction of the recording medium becomes narrow, the processing speed decreases when an attempt is made to record with high quality to a recording medium with a broad width, and the processing speed cannot be increased or the productivity improved when images are recorded with high quality to a narrow recording medium.

In the invention cited in Japanese Patent Application Publication No. 11-334047, there are drawbacks in that the apparatus configuration has considerable redundancy because a compensating auxiliary head must be jointly provided for each color in addition to a regular line head. In the invention cited in Japanese Patent Application Publication No. 9-24627, the direction of the once printed recorded paper is reversed, print defects are detected, and a determination is made as to whether to reprint, so regardless of the presence of a print defect, the recording paper always reciprocates through the print head, and productivity is poor. Furthermore, only a normally functioning dot print element disposed at a predetermined distance from the defective dot print elements is used for printing, bringing about a drawback whereby the print defects are not necessarily completely retouched due to the skewing or other effect of the recording paper.

SUMMARY OF THE INVENTION

The present invention is contrived in view of such circumstances, and an object thereof is to provide an image recording apparatus that can record at high speed to a recording medium with a plurality of width sizes using a single recording head without a loss of resolution, and that can retouch defective pixels without complicating the configuration of the apparatus and increasing the cost.

To achieve the above-stated object, the present invention provides an image recording apparatus for recording images to a recording medium with a line recording head in which a plurality of image-recording elements are arrayed, wherein the apparatus has a recording head arrangement device for arranging the line recording head so that at least a lengthwise direction of the line recording head is in an orthogonal position substantially orthogonal to a conveyance direction of the recording medium, or the lengthwise direction of the line recording head is in a parallel position substantially parallel to the conveyance direction of the recording medium, and also has a shuttle scan mechanism for causing the line recording head to shuttle-scan in the direction substantially orthogonal to the conveyance direction while the parallel position is maintained; and wherein the line recording head records images as a line head when arranged in the orthogonal position, and records images by shuttle scanning when arranged in the parallel position.

Images can thereby be recorded at a high speed to a large recording medium, and productivity can be improved by configuring the line recording head to shuttle-scan in the direction parallel to the conveyance direction, in addition to the regular recording of images as a line head.

The recording head arrangement device is preferably a rotating device that can rotate the line recording head in the plane parallel to the conveyance plane of the recording medium. The position of the line recording head can easily be moved by rotating the head with the rotation device.

The image recording apparatus of the present invention further has a width detection device for detecting the width of the recording medium in the conveyance direction, wherein the line recording head is set in the orthogonal position to record images as a line head when the width of the recording medium detected by the width detection device is substantially the same as the effective recording width of the image-recording elements in the lengthwise direction of the line recording head, and the line recording head is set in the parallel position to record images by the shuttle scanning when the width is greater than the effective recording width of the image-recording elements in the lengthwise direction of the line recording head.

Images can thereby be rapidly recorded with at least one line recording head to a recording medium with a plurality of differing widths.

The image recording apparatus of the present invention is configured such that the line recording head is arranged in a position inclined at a predetermined angle with respect to the orthogonal position when the width of the recording medium detected by the width detection device is less than the effective recording width of the image-recording elements in the lengthwise direction of the line recording head, and the dot pitch in the conveyance direction is set to a predetermined degree of sparseness in accordance with the inclined angle to record images.

Images can thereby be rapidly recorded without a loss of resolution even when the recording medium is narrower than the line recording head.

The image recording apparatus of the present invention further has a defective pixel detection device for detecting defective pixels in an image recorded to the recording medium on the downstream side in the conveyance direction of the line recording head, wherein at least one of the recording head arrangement device and the shuttle-scan mechanism is driven when a defective pixel has been detected, and the defective pixel is restored by re-recording images using a different nozzle than the nozzle that recorded the defective pixel.

Defective pixels can thereby easily be retouched by recording images with a normally functioning image-recording element for a second time even if a defective pixel is found.

In accordance with the image recording apparatus related to the present invention described above, it is possible to record images at high speed to a recording medium with a plurality of width sizes using a single recording head without a loss of resolution. Also, when images are recorded for a second time with a normally functioning image-recording element to a defective pixel, it is also possible to retouch defective pixels without complicating the configuration of the apparatus and increasing the cost.

BRIEF DESCRIPTION OF THE DRAWINGS

FIGS. 5A to 5D are description diagrams showing high-speed recording with a narrow width using the inkjet head of the present embodiment, FIG. 5A is a plan view showing the rotation of the inkjet head, FIG. 5B is a plan view showing the ink landing position when an image is recorded at an orthogonal position; FIG. 5C is a plan view showing the ink landing position when the nozzles are simultaneously driven in a state in which the inkjet head has been rotated, and FIG. 5D is a plan view showing the ink landing position when the nozzles are sequentially driven in a state in which the inkjet head has been rotated;

FIG. 6A shows the case of recording an image at the intermediate width of a regular line head, FIG. 6B shows the case of recording an image at a narrow width in which the inkjet head has been rotated to a predetermined angle, and FIG. 6C shows the case of recording an image at a considerable width by rotating the inkjet head 90° and shuttle scanning.

DETAILED DESCRIPTION OF THE PREFERRED EMBODIMENTS

The image recording apparatus related to the present invention is described in detail below with reference to the attached diagrams.

Figure 1:
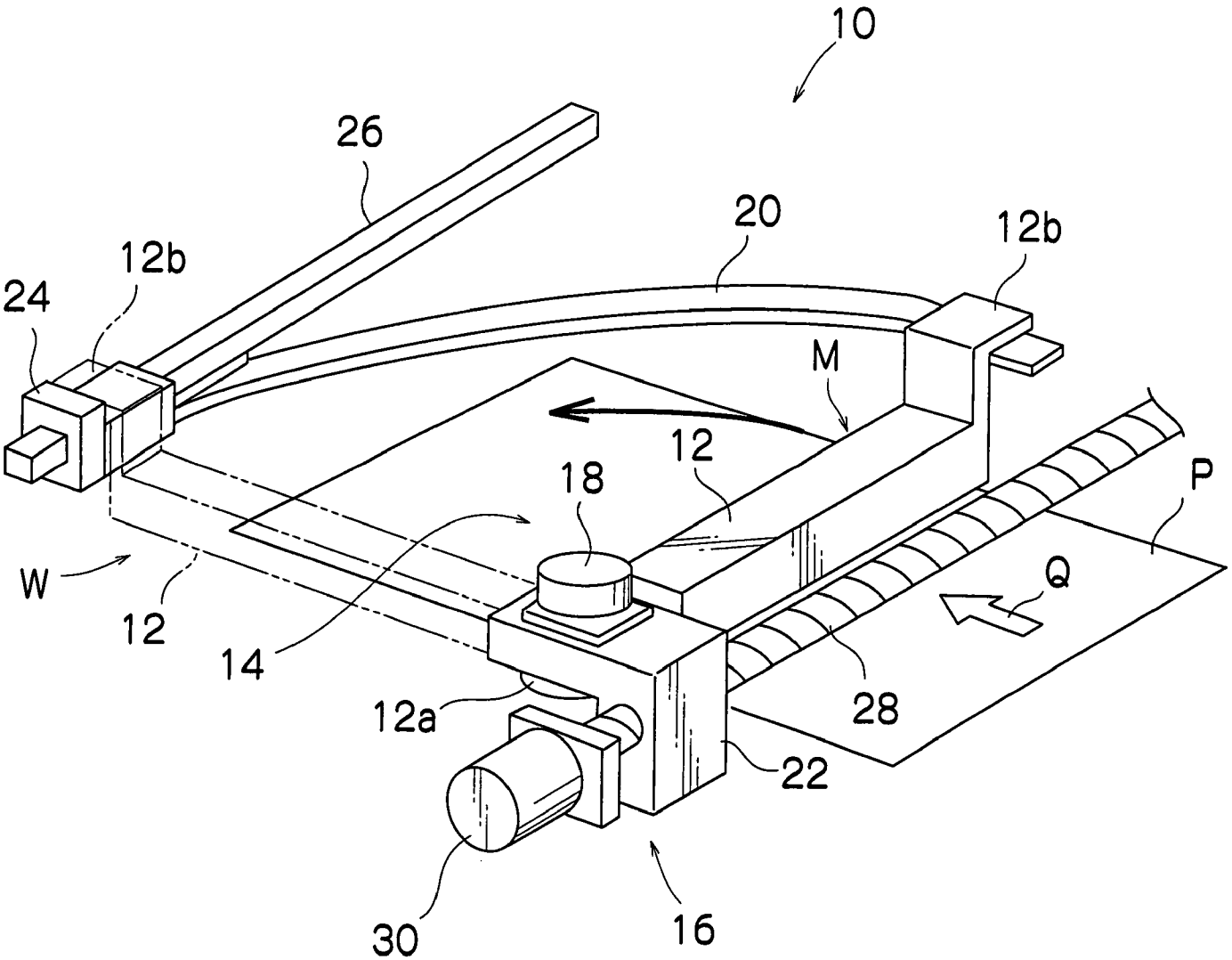
FIG. 1 is a partial schematic perspective diagram showing an embodiment of the image recording apparatus related to the present invention.

FIG. 1 is a partial schematic perspective diagram showing an embodiment of the image recording apparatus related to the present invention. In the present embodiment, an inkjet printer having a line inkjet head (recording head) in which a plurality of nozzles (image-recording elements) for discharging ink toward recording paper are arrayed in a straight line is described as an example of an image recording apparatus, but the present invention is not limited to inkjet printers.

The image recording apparatus (hereinafter referred to as inkjet printer) 10 of the present embodiment has a line inkjet head 12 in which a plurality of nozzles (ink discharge ports) are arrayed in a line, and the apparatus records (prints) images to the recording paper P conveyed in the direction indicated by the arrow Q in the diagram, as shown in FIG. 1.

The line inkjet head 12 of the present embodiment is configured so that the lengthwise direction (nozzle array direction) thereof is arranged the direction (hereinafter referred to as the orthogonal position M) substantially orthogonal to the conveyance direction Q of the recording paper P, as shown in the diagram, and not only records images as a line head, but is also configured so that the lengthwise direction thereof is arranged in a direction (hereinafter referred to as the parallel position W) that is substantially parallel to the conveyance direction Q of the recording paper P, as shown by the two-dot chain line in the diagram, to allow shuttle scanning (shuttle scan) in the direction substantially orthogonal to the conveyance direction Q of the recording paper P while maintaining a parallel orientation with the conveyance direction Q.

To make this possible, the inkjet printer 10 of the present embodiment has a recording head arrangement device 14 for arranging the inkjet head 12 in the orthogonal position M and parallel position W, and a shuttle scanning mechanism 16 for causing the inkjet head 12 to shuttle-scan in the direction substantially orthogonal to the conveyance direction Q while keeping the inkjet head 12 in the direction substantially parallel to the conveyance direction Q of the recording paper P.

The recording head arrangement device 14 is principally composed of a rotation motor 18 for rotating the inkjet head 12 between the orthogonal position M indicated by the solid line in the diagram and the parallel position W indicated by the two-dot line chain line in the diagram, and a guide plate 20 for holding and reliably rotating one end of the inkjet head 12.

In other words, the inkjet head 12 is configured such that the end portion 12*a* thereof is axially supported on the support member 22, and the head is rotated by the rotation motor 18 about an axle (directly coupled to the rotating axle of the rotation motor 18, but omitted from the diagram) on which the end portion 12*a* is pivotally supported. In this case, the end portion 12*b* formed in the shape of the letter "L" at the other end of the inkjet head 12 is positioned on the guide plate 20, and moves thereon while guided by the guide plate 20. Here, the inkjet head 12 is axially supported on the support member 22, but the end portion 12*b* is not necessarily required to be in contact with the guide plate 20 and to slide thereon. The end portion 12*b* does not move down any further because of the guide plate 20. The inkjet head 12 rotates between the orthogonal position M and the parallel position W while the nozzle face (not shown) provided to the bottom side thereof keeps a substantially constant distance to the conveyance plane of the recording paper P.

The other end portion 12*b* of the inkjet head 12 is supported by another support member 24 in the parallel position W indicated by the two-dot chain line in the diagram. The support member 24 can move on a slider (direct-action rail or the like, for example) 26 extended in the direction substantially orthogonal to the conveyance direction Q. The inkjet head 12, when in the parallel position W, moves in the direction substantially orthogonal to the conveyance direction Q to perform shuttle scanning.

The shuttle scan mechanism 16 for shuttle-scanning the inkjet head 12 is configured with a ball screw 28 extended in the direction substantially orthogonal to the conveyance direction Q so that the support member 22 by which one end portion 12*a* of the inkjet head 12 is supported moves thereon. A movement motor 30 for driving the screw is also provided.

When the ball screw 28 is driven by the movement motor 30, the support member 22 for supporting one end portion 12*a* of the inkjet head 12 moves on the ball screw 28, and the support member 24 for supporting the other end portion 12*b* moves in the same manner in conjunction therewith along the slider 26 to perform shuttle scanning. At this time, the support member 24 holds the end portion 12*b* of the inkjet head 12 in place with an electromagnet, for example, and prevents the inkjet head 12 from rattling during movement. When the inkjet head 12 is returned to the orthogonal position M, the electromagnet is switched off, and the end portion 12*b* is released.

Figure 2A:
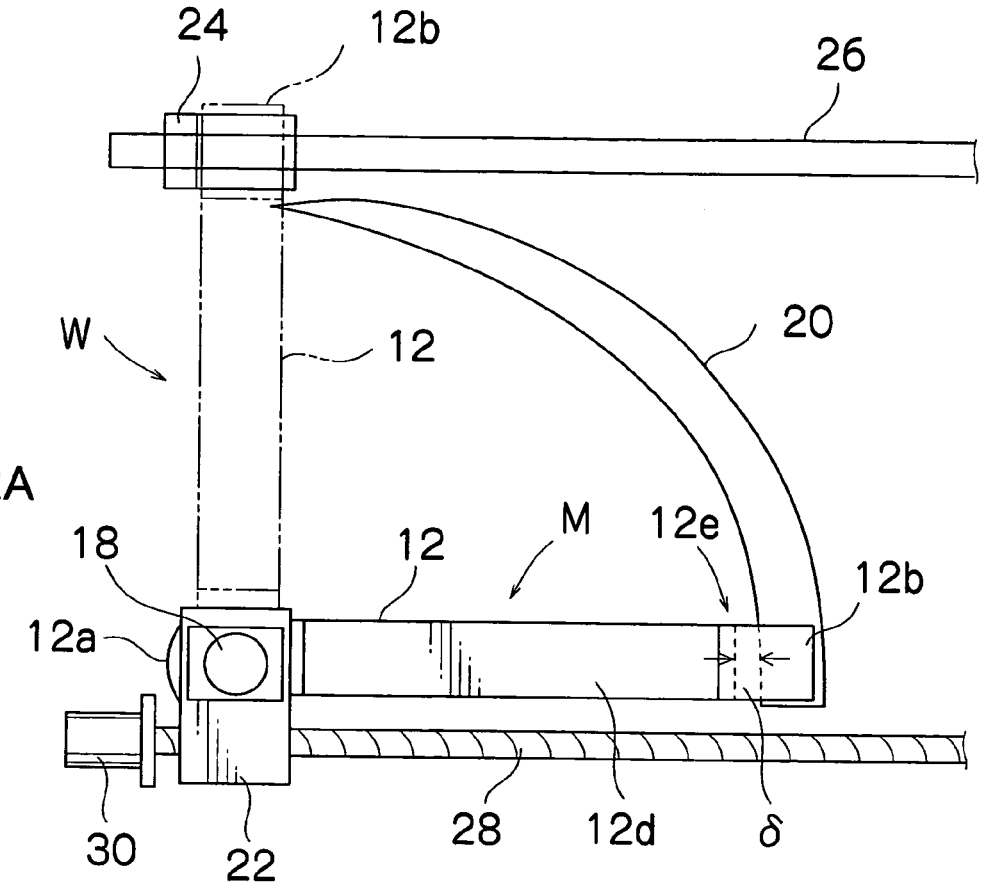
FIG. 2A is a partial plan view of the image recording apparatus (inkjet printer) of FIG. 1.
Figure 2B:
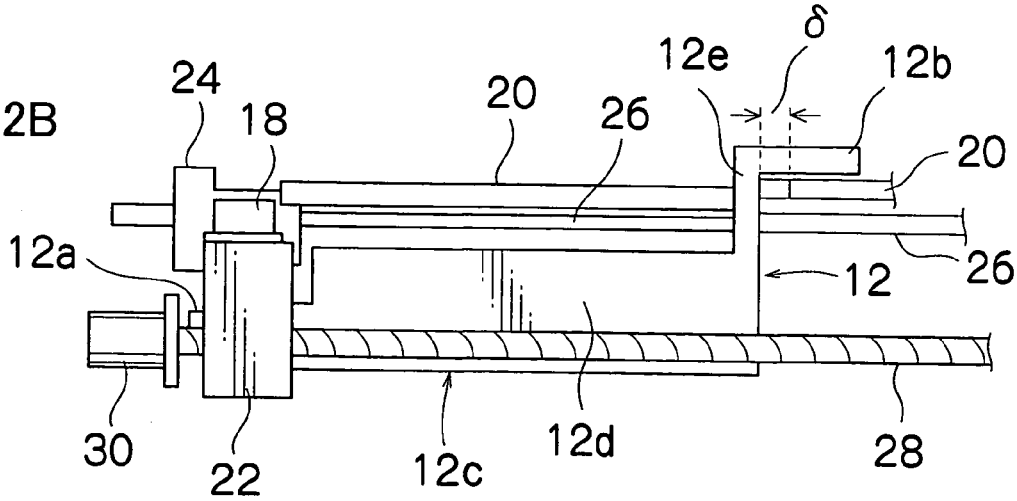
FIG. 2B is a partial side view of the same.

FIG. 2A shows a partial plan view of the inkjet printer shown in FIG. 1, and FIG. 2B shows a partial side view seen from the right-hand side (seen from the upstream side of the conveyance direction Q) of the same inkjet printer shown in the FIG. 1.

The ball screw 28 for moving the support member 22 supporting one end portion 12*a* of the inkjet head 12, and the slider 26 for moving the support member 24 supporting the other end portion 12*b* of the inkjet head 12 in the parallel position W are arranged to be substantially parallel, as shown in FIG. 2A, and the guide plate 20 is arranged therebetween in the form of a quadrant. The inkjet head 12 rotates about the axis of rotation of the rotation motor 18 between the orthogonal position M and the parallel position W, with the end portion 12*b* guided by the guide plate 20.

FIG. 2B is a side view as seen from the bottom side of FIG. 2A when the inkjet head 12 of FIG. 2A is in the orthogonal position M. The head main body 12*d* having a nozzle surface 12*c* on the bottom side of the inkjet head 12, as shown in FIG. 2B, is arranged so as to be positioned further below the guide plate 20. Even when the inkjet head 12 thereby moves from the parallel position W indicated by the two-dot chain line in FIG. 2A in the rightward direction while remaining parallel to perform shuttle scanning, the head main body 12*d* passes on the bottom side of the guide plate 20, so the head main body 12*d* does not collide with the guide plate 20. The guide plate 20 is fixed to the fixed member (not shown) so as to avoid interference with movement of the inkjet head 12.

The perpendicular portion 12*e* of the end portion 12*b* formed in the shape of the letter "L" of the inkjet head 12 has a small gap δ with the guide plate 20. Rotation along the guide plate 20 of the inkjet head 12 can thereby be smoothly performed, and it is possible to move (shift) the inkjet head 12 slightly in the axial direction of the ball screw 28 when restoring defective pixels described hereafter.

Figure 3:
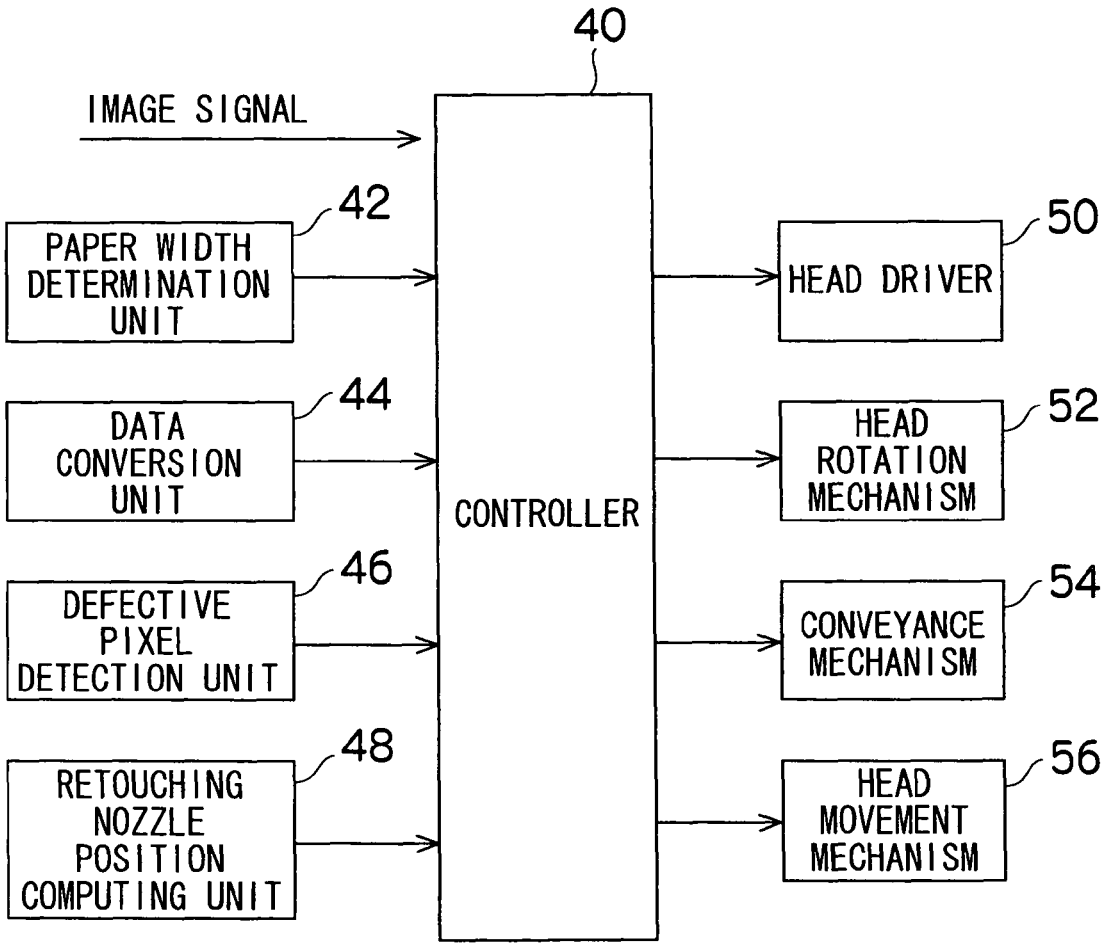
FIG. 3 is a block diagram showing the system configuration of the inkjet printer of the present embodiment.

FIG. 3 is a block diagram showing the system configuration of the inkjet printer 10 of the present embodiment. The inkjet printer 10 of the present embodiment has a controller 40 for controlling the operation of the entire system, as shown in FIG. 3; image signals and various other signals are input to the controller 40; and the operation of drivers and other components is controlled based on the input signals therefrom. In FIG. 3, the left side of the controller 40 is the system for inputting data to the controller 40, and the right side is the system for outputting data from the controller 40.

The system for inputting data to the controller 40 includes a paper width determination unit 42, data conversion unit 44, defect image detection unit 46, retouching nozzle position computing unit 48, and the like, and the system for outputting data from the controller 40 include a head driver 50, head rotation mechanism 52, conveyance mechanism 54, head movement mechanism 56, and the like.

The paper width determination unit 42 detects the paper width of the recording paper P. The detection method thereof is not particularly limited, and a variety of different methods may be used. Possible methods include, for example, a configuration in which recording paper P is set in a magazine (in the case of roll paper), cassette (in the form of sheets if cut paper is used), or other recording paper supply unit when image recording is started, the apparatus performs a function for identifying the paper width from the magazine ID information, and the detection signal therefrom is sent to the paper width determination unit 42; or a configuration in which recording paper is fed from the supply unit, the width of the recording paper P conveyed to the recording head (inkjet head 12) is detected by a sensor (CCD sensor or the like, for example), and the paper width is determined from the detection signal thereof in the paper width determination unit 42. It is also possible for the operator to directly input the paper width to the paper width determination unit 42.

The data conversion unit 44 converts the data to be sent (for recording) to the inkjet head 12 if data conversion is required when the inkjet head 12 is positioned in the orthogonal position M to record images with a regular line head, or when the inkjet head 12 is positioned in the parallel position W to record images by shuttle scanning.

The defective pixel detection unit 46 in the inkjet printer 10 detects which pixel is defective and which nozzle is defective on the basis of the signal from a defective pixel detection sensor (not shown) disposed on the downstream side in the conveyance direction Q of the inkjet head 12. The sensor for detecting defective pixels is not particularly limited. The sensor may read the recording image with the CCD and analyze the read image to detect defective pixels, or non-discharging nozzles may be detected with a non-discharge detecting sensor disposed immediately behind the inkjet head 12.

The retouching nozzle position computing unit 48 computes and determines the manner in which the inkjet head 12 should move (rotation, a combination of rotation and shifting, or the like) and the exact nozzle that should be used to retouch the defective pixel detected by the defective pixel detection unit 46.

The head driver 50 drives the inkjet head 12, controls ink discharge from the nozzles, and discharges ink from the nozzles in accordance with the input image signal to record images.

The head rotation mechanism 52 corresponds to the recording head arrangement device 14 described above, and more specifically is composed of a rotation motor 18 having a function for rotating the inkjet head 12 by a predetermined angle between the orthogonal position M and the parallel position W, and a guide plate 20, as described with reference to FIG. 1, 2A or 2B.

The conveyance mechanism 54 draws recording paper P from the recording paper supply unit, conveys the paper to the inkjet head 12, and conveys the recording paper P on which an image has been recorded to the paper discharge unit. Recording paper P used here may be long roll paper loaded into a magazine and drawn therefrom to be cut (or directly used without cutting) to a predetermined length, or may be cut paper cut in the form of sheets that has a predetermined length and is loaded into a cassette in advance.

The head movement mechanism 56 corresponds to the shuttle scan mechanism 16, drives the ball screw 28 with the movement motor 30, and moves the inkjet head 12 in the direction substantially orthogonal the conveyance direction Q. The inkjet head 12 performs shuttle scanning by moving the inkjet head 12 in the parallel position W shown in FIG. 2A directly right and left. More specifically, the inkjet head 12 is moved slightly toward the ball screw 28 by the head movement mechanism 56 during pixel restoration, and allows defective pixels to be retouched by reprinting the defective pixels with a normally functioning nozzle that is not defective.

Thus, the inkjet printer 10 of the present embodiment is provided with a paper width determination unit 42, the width of the recording paper P is detected by a CCD or another sensor as described above, and images can be recorded in accordance with the width thereof. The method for recording an image in accordance with the width of the recording paper is described below.

Here, for the sake of simplicity, three types of paper width are used: narrow, intermediate, and broad. A narrow width is defined as an L size with a width of 127 mm×89 mm; an intermediate width is defined as an A4 size with a width of 297 mm×210 mm; and a broad width is defined as an A2 size with a width of 420 mm×594 mm.

Figure 4:
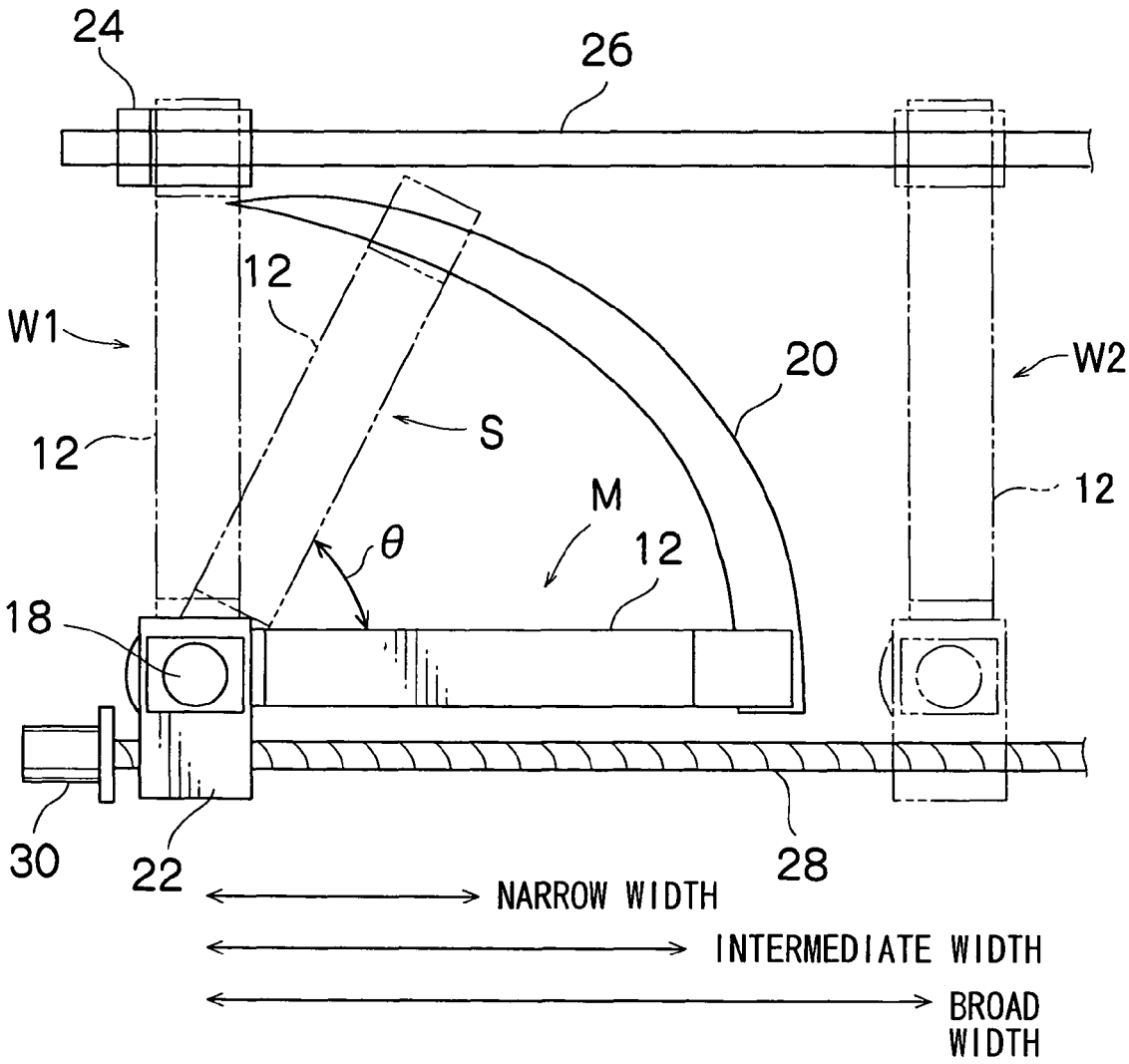
FIG. 4 is a plan view showing the state in which recording is performed with a plurality of widths using the inkjet head of the present embodiment.

When it has been determined by the paper width determination unit 42 that the paper width is substantially the same as the recording width of the inkjet head 12, i.e., that the paper has intermediate width, the inkjet head 12 is arranged in the orthogonal position M, as shown in FIG. 4, and images are recorded with a regular line head.

When it has been determined that the paper width is greater than the recording width of the inkjet head 12, i.e., that the paper has broad width, as shown in FIG. 4, the inkjet head 12 is rotated by 90° from the orthogonal position M to the parallel position W1, and is moved to the position shown by the key symbol W2 directly in the lateral direction (ball screw 28 direction) to perform shuttle scanning therebetween. Images can thereby be recorded using the same inkjet head 12 even when the width of the recording paper P is greater than the recording width of the inkjet head 12.

When it has been determined that the recording paper P is narrower than the inkjet head 12, as shown by the key symbol S in FIG. 4, the inkjet head 12 is rotated by a predetermined angle θ from the orthogonal position M that is substantially orthogonal to the conveyance direction Q, the inkjet head 12 is set in the inclined position S, and the inkjet head 12 records images in this inclined state. The apparent recording density increases in the lateral direction of the diagram with this configuration. In view of the above, high-speed recording is made possible without reducing the resolution by setting the dot pitch in the conveyance direction Q (refer to FIG. 1) of the recording paper P to a predetermined degree of sparseness in accordance with the inclined angle θ of the inkjet head 12 to record an image.

This is now described using as an example the case in which the nozzles of the inkjet head 12 are arrayed in a single row A, as shown in FIG. 5A. When the inkjet head 12 is in the orthogonal position (θ=0°) indicated by the key symbol M in FIG. 5A, the recording paper P is conveyed at a conveyance velocity V (mm/s), the nozzles n1 to n4 of the row A are simultaneously discharged, the discharge frequency is set to f0 (Hz), and a solid image is formed on the entire surface. The position occupied by the ink after landing on the recording paper at this time is shown in FIG. 5B. The pitch x of the ink droplet that has landed on the recording paper in the paper conveyance direction indicated by the arrows in the diagram is x=V/f0 (mm). The pitch in the direction (paper width direction) orthogonal to the paper conveyance direction is a (mm).

The inkjet head 12 simultaneously discharges each of the nozzles n1, n3, and n5 in the row A, with the conveyance velocity of the recording paper P being set to 2V (mm/s) (in other words, double velocity) at a position S reached by rotation through an angle θ=60°, for example. The position occupied by the ink after landing on the recording paper at this time is shown in FIG. 5C. The pitch of the landed ink in the recording paper conveyance direction at this time is 2x=2V/f0 (mm). The pitch in the paper width direction is a/2 (mm). When the nozzles of row A are simultaneously driven, recording is performed at a pitch of 2x in the paper conveyance direction with the same shape as when the nozzles are aligned in the inkjet head 12. FIG. 5D shows the corresponding position of the ink after landing when the discharge timing is such that the nozzles of row A are driven sequentially one at a time from the left side. In this case, in droplets aligned in a single lateral row in the paper width direction at a pitch of a/2 (mm) are recorded in the paper conveyance direction at a pitch of 2x in the same positions in the paper conveyance direction. It is apparent from the diagrams that the number of landed dots per unit surface area remains the same in all these cases. In other words, in the position S in which the inkjet head 12 has been rotated 60°, the pitch in the paper width direction has been doubled, so the paper conveyance velocity in the paper conveyance direction can be doubled and the dot pitch in the conveyance direction can be made doubly sparse while the same resolution is maintained.

The same resolution is ensured when the inkjet head 12 is used to record images at a conveyance velocity V in the orthogonal position M, and when the inkjet head 12 in the position S has been rotated 60° from the orthogonal position M, the conveyance velocity has been doubled, and each nozzle is used to record the images. In other words, the conveyance velocity of the recording paper P can be increased by rotating the inkjet head 12 without varying the discharge frequency f0, and productivity can be improved without a loss of resolution (image quality), which is the number landed dots per unit surface area of the paper containing the image.

It is apparent that image data must be converted in a corresponding manner when images are recorded in a state in which the inkjet head has been rotated through a predetermined angle in this manner, or when images are recorded while the inkjet head is shuttle-scanned after being rotated through an angle of 90°. As described above, the image data is converted in the data conversion unit 44.

Figure 6A:
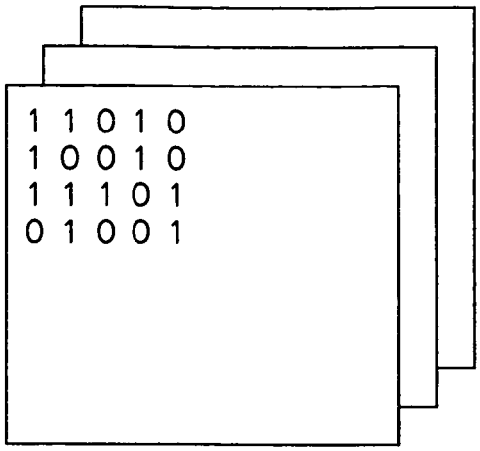
FIGS. 6A to 6C are conceptual diagrams showing the states of image data conversion in the data conversion unit.
Figure 6B:
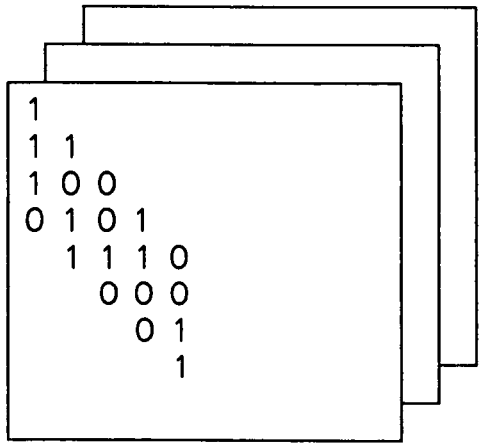
Figure 6C:
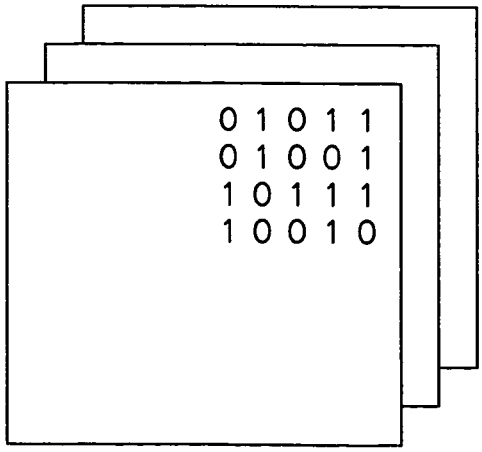

FIGS. 6A to 6C show the concept of image data conversion in the data conversion unit 44. FIG. 6A shows the case of recording paper P with an intermediate width in which the inkjet head 12 is arranged in the orthogonal position M, and shows the bit map data for the colors Y, M, and C as data for recording images with a regular line head. FIG. 6B shows data in the case of recording paper P with a narrow width in which the inkjet head 12 is rotated by a predetermined angle θ and in which the inkjet head 12 is inclined. The figure shows the bit map data of the colors Y, M, and C when data is converted from the data in FIG. 6A in the data conversion unit 44. FIG. 6C shows data in the case of recording paper P with a broad width in which the inkjet head 12 is arranged in the parallel position W and the data is used when recording an image by shuttle scanning. The figure shows the bit map data of the colors Y, M, and C when data is converted from the data in FIG. 6A in the data conversion unit 44.

When images are recorded in the positions of the inkjet head 12 arranged in accordance with the intermediate, narrow, and broad widths of the recording paper, data converted in accordance with the cases shown above is sent to the inkjet head arranged in these positions, and ink is discharged in accordance with the respective data from the nozzles of each color to record the images.

When the width is broad, the inkjet head 12 is arranged in a position (parallel position W) rotated by 90° from the orthogonal position M, as described above, and a maintenance area may be provided in the position rotated by 90°. In other words, capping, suctioning, wiping, and other maintenance processes may be carried out in this maintenance area. Maintenance-related equipment can be provided in the position rotated by 90° in this manner without interfering with the conveyance of the recording paper or other operations.

The operation of the present embodiment is described below with reference to the flowchart of FIG. 7.

Figure 7:
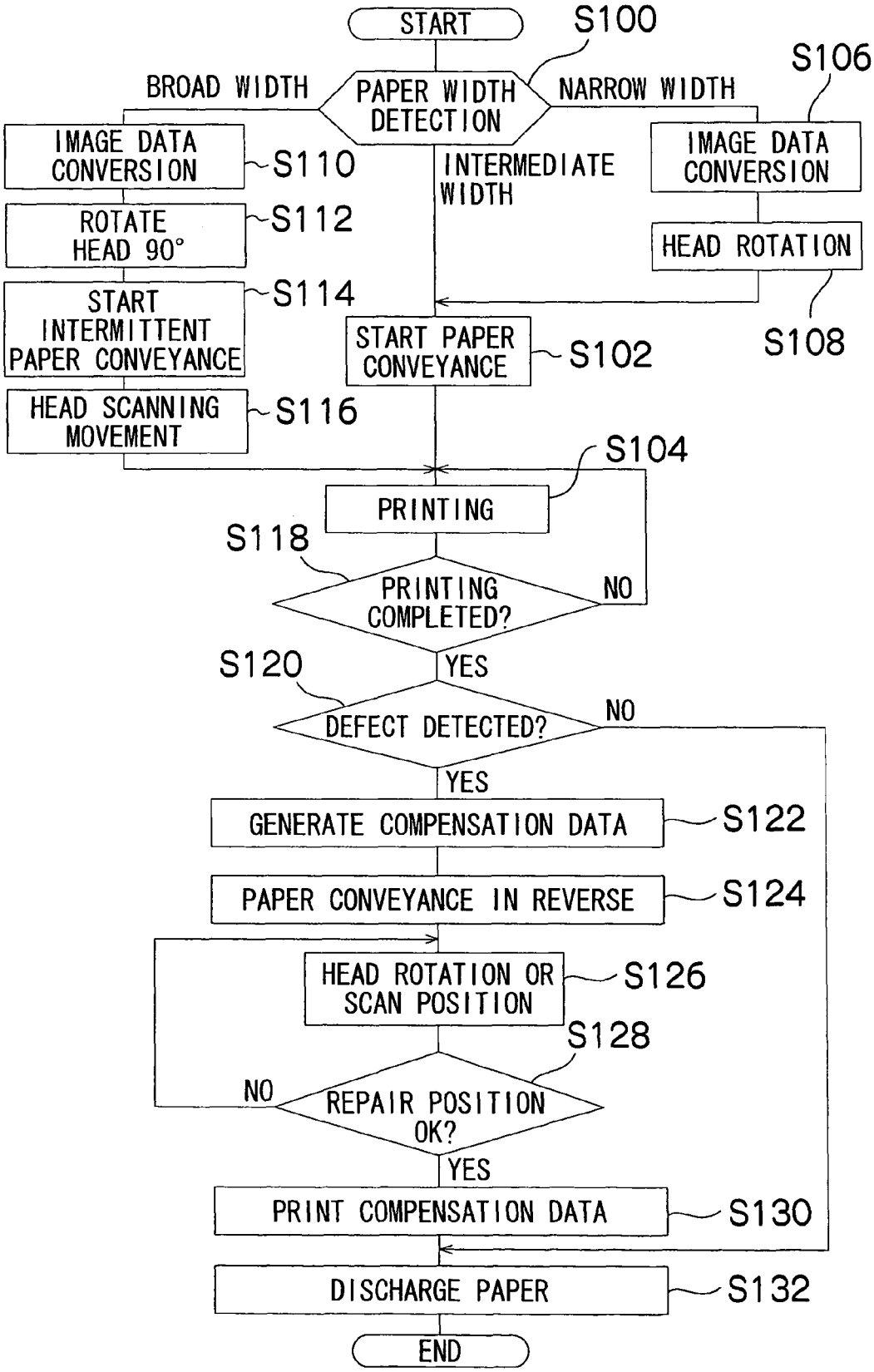
FIG. 7 is a flowchart showing the operation of the present embodiment.

When image recording is started, the width of the recording paper P is first detected with the paper width determination unit 42 in step S100 of FIG. 7, and processing is carried out for a narrow width, intermediate width, or broad width in accordance with the width of the recording paper P. However, the method of detecting the paper width in the paper width determination unit 42 as described above is not particularly limited, and a variety of methods are available, but shown in the flowchart of FIG. 7 is the case in which the paper width is detected prior to conveying the recording paper P. In this case, the apparatus may automatically detect the paper width when recording paper P is set in the recording paper supply unit, and the detection signal thereof be sent to the paper width determination unit 42, or the operator may directly input the paper width.

When the width of the recording paper P is an intermediate width (L size with a width of 127 mm, for example), the process advances to step S102, and conveyance of the recording paper P is started. In the subsequent step S104, image recording (printing) is carried out in the regular line head mode, with the inkjet head 12 set in the orthogonal position M. In this case, regular printing is carried out and, in particular, image recording is performed using data such as that shown in FIG. 6A, for example, without converting the image data in the data conversion unit 44.

As described above, adopted herein is an example of detecting the paper width prior to conveying the recording paper P, so paper conveyance is started after the paper width has been detected. When, however, the recording paper P is conveyed and the width of the recording paper P being conveyed is detected by a sensor, the order in the flowchart of FIG. 7 can be reversed, paper conveyance is started first, and the width of the paper is detected thereafter.

When it has been determined that the width of the recording paper is narrow in step S100, the inkjet head 12 is rotated by a predetermined angle θ to record an image, as described above, so the process advances to step S106, and image data is converted in the data conversion unit 44 so correlated data is obtained. The data may be converted to data such as that shown in FIG. 6B, for example.

Next, in step S108, the rotation motor 18 is driven, and the inkjet head 12 is arranged in the position S (refer to FIG. 4), which results from rotation through the predetermined angle θ. Next, in step S104, the recording paper P is conveyed at a predetermined velocity, and an image is recorded. In this case, as described above, the pixel density is higher in the lateral direction (direction substantially orthogonal to the conveyance direction), so the conveyance velocity can be increased, the dot pitch set to be more sparse to perform recording, the recording speed increased, and productivity improved.

When it has been determined that the width of the recording paper is broad in step S100, the inkjet head 12 is rotated by 90° and set in the parallel position W, as described above, and shuttle scanning is performed at this point to record images, so the process advances to step S110, and the image data is converted in the data conversion unit 44 to correlated data such as the data shown in FIG. 6C, for example.

Next, in step S112, the rotation motor 18 is driven, and the inkjet head 12 is rotated by 90° from the orthogonal position M to the parallel position W. In step S114, intermittent paper conveyance is started; and in step S116, the movement motor 30 is driven and the inkjet head 12 is moved and scanned in the direction substantially orthogonal to the conveyance direction Q. Thus, image recording is performed by shuttle scanning in step S104.

Steps S104 and thereafter are the same for cases in which the width of the recording paper P is narrow, intermediate, or broad. Next, in step S118, a determination is made as to whether image recording (printing) has been completed. When image recording is not yet completed, the process returns to step S104 and image recording is continued.

When image recording has been completed, detection of defective pixels is carried out in the next step S120, and a determination is made with the defective pixel detection unit 46 as to whether there are defective pixels. When defective pixels are not detected, the process immediately advances to step S132 and the recorded paper P is discharged to complete the processing.

When a defective pixel has been detected in step S120, retouch data is generated in the subsequent step S122. A determination is made in the retouch nozzle position computing unit 48 on the basis of detection data from the defective pixel detection unit 46 as to which nozzle should be used and what retouching should be carried out, and image data is generated (or data is converted) in accordance therewith.

Once the retouching method has been determined, the recording paper P with defective pixels is conveyed in reverse in the subsequent step S124. In the next step S126, the inkjet head 12 is arranged in a position required by the retouching method determined above. In other words, the inkjet head 12 is arranged so that the defective pixels can be reprinted with normally functioning nozzles.

When the recording paper P is narrow, the inkjet head 12 records an image at a position rotated by a predetermined angle, but when defective pixels are detected in this case, the angle of the inkjet head 12 is shifted in the lateral direction or rotated by a slight angle, and the head is moved to the parallel position so that shuttle scanning can be performed, or a number of these are suitably combined to arrange the inkjet head 12 so as allow defective pixels to be recorded a second time with normally functioning nozzles (restoring nozzles) that are different from the defective nozzles.

When the width of the recording paper P is intermediate, the inkjet head 12 records an image in the orthogonal position, but when defective pixels are detected in this case, the inkjet head 12 is slightly rotated, or the head is slightly shifted in the lateral direction while remaining in the orthogonal position, or the head is moved to the parallel position so that shuttle scanning can be performed. Alternatively, a number of these may be suitably combined to arrange the inkjet head 12 so as allow defective pixels to be recorded a second time with normally functioning nozzles that are different from the defective nozzles.

When the width of the recording paper P is broad, the inkjet head 12 performs shuttle scanning to record an image in the parallel position, but when defective pixels are detected in this case, the inkjet head 12 performs shuttle scanning while remaining in the parallel position, or the angle thereof is slightly rotated, or the head is moved with a combination of rotating and shifting such that the inkjet head 12 is arranged so as allow defective pixels to be recorded a second time with normally functioning nozzles that are different from the defective nozzles.

As shown in FIG. 2B, a gap δ is present at this point between the guide plate 20 and the perpendicular portion 12*e* of the end portion 12*b* formed in the shape of the letter "L," so the inkjet head 12 can be shifted in the lengthwise direction thereof by an amount equivalent to at least this gap δ. By adopting such a configuration it is possible to retouch images without changing the position of the paper in the width direction, and a paper position movement mechanism can be dispensed with.

Next, in step S128, a determination is made prior to reprinting as to whether the retouch position is acceptable, and when the retouch position is not acceptable, the process returns to step S126, and the position of the inkjet head 12 is rearranged. When the retouch position is acceptable, the process advances to the next step S130, where the defective pixel is retouched by reprinting with the inkjet head 12 in the retouch position while the recording paper P that has been conveyed in reverse is re-conveyed.

The image is recorded for a second time in the vicinity of the defective pixels with a normally functioning nozzle without performing restorative action on the defective nozzle at this time. Wasted recording paper can be avoided by re-recording images on the recorded recording paper that has defective pixels. Time is required for operations to restore the nozzle, so reprinting with normally functioning nozzles is preferred when processing must be performed in a short period of time.

Recording paper that has been retouched and quality recording paper that does not have defective pixels is discharged in the next step S132 to complete processing.

Thus, in accordance with the present embodiment, it is possible to record images to recording paper with a plurality of widths (for example, three types of paper widths: a narrow width, intermediate width, and broad width) using a single inkjet head, and when recording images on broad paper whose width is greater than the width of the inkjet head, for example, the inkjet head can be rotated by 90° to directly perform shuttle scanning and to record images on the broad paper, so the burden of manufacturing a long inkjet head for broad width recording can be reduced.

Providing an inkjet head with a width equal to an intermediate width allows images to be recorded to a medium with an intermediate width using a regular line head, and recording images to a medium with a narrow width using an inclined inkjet head allows the conveyance velocity of the recording paper to be increased and productivity to be improved.

When defective pixels are detected, they can be easily retouched by re-recording images with normally functioning nozzles other than nozzles with defects (non-discharging nozzles or the like) by rotating the inkjet head, shifting the head in the lateral direction, or combining shifting with rotation.

The image recording apparatus of the present invention was described above in detail, but the present invention is not limited to the above examples, and various improvements and modifications may naturally be carried out within the scope that does not depart from the spirit of the present invention.

What is claimed is:

1. An image recording apparatus for recording images to a recording medium with a line recording head in which a plurality of image-recording elements are arrayed to have an effective recording width in a lengthwise direction of the line recording head, comprising:

a recording medium conveyance device which conveys the recording medium in a recording medium conveyance direction relatively to the line recording head;

a width detection device for detecting a width of the recording medium in a recording medium widthwise direction orthogonal to the recording medium conveyance direction;

a recording head arrangement device for turning and positioning the line recording head so that the line recording head is in at least one of an orthogonal position where the lengthwise direction of the line recording head is substantially orthogonal to the recording medium conveyance direction, and an inclined position where the lengthwise direction of the line recording head is inclined at a predetermined angle with respect to the recording medium conveyance direction; and a control device which controls the line recording head, the recording medium conveyance device and the recording head arrangement device, wherein when the width detection device detects that the width of the recording medium is substantially the same as the effective recording width of the line recording head, the control device controls the recording head arrangement device to position the line recording head in the orthogonal position, and controls the line recording head and the recording medium conveyance device to record an image onto the recording medium at a first image resolution per unit surface area while conveying the recording medium at a first conveyance velocity relatively to the line recording head positioned in the orthogonal position, and wherein when the width detection device detects that the width of the recording medium is less than the effective recording width of the line recording head, the control device controls the recording head arrangement device to position the line recording head in the inclined position, and controls the line recording head and the recording medium conveyance device to record an image onto the recording medium at a second image resolution per unit surface area while conveying the recording medium at a second conveyance velocity relatively to the line recording head positioned in the inclined position, the control device maintaining the second image resolution per unit surface area substantially the same as the first image resolution per unit surface area by setting the second conveyance velocity higher than the first conveyance velocity to increase a dot pitch in the recording medium conveyance direction to compensate for a decrease of a dot pitch in the recording medium widthwise direction caused by positioning the line recording head in the inclined position.

2. The image recording apparatus according to claim 1, wherein the recording head arrangement device is a rotating device that can rotate the line recording head by the predetermined angle in a plane parallel to a conveyance plane of the recording medium.

3. The image recording apparatus according to claim 2, wherein:

the recording head arrangement device turns and positions the line recording head so that the line recording head is in at least one of the orthogonal position, the inclined position, and a parallel position where the lengthwise direction of the line recording head is substantially parallel to the recording medium conveyance direction;

the image recording apparatus further comprises a shuttle-scan mechanism for performing shuttle-scanning which causes the line recording head positioned in the parallel position to move to shuttle-scan the recording medium in a direction substantially orthogonal to the recording medium conveyance direction while maintaining the line recording head in the parallel position; and when the width detection device detects that the width of the recording medium is greater than the effective recording width of the line recording head, the control device controls the recording head arrangement device to position the line recording head in the parallel position, and controls the line recording head, the recording medium conveyance device and the shuttle-scan mechanism to record an image onto the recording medium while performing the shuttle-scanning.

4. The image recording apparatus according to claim 3, further comprising a defective pixel detection device for detecting a defective pixel in the image having been recorded on the recording medium, the defective pixel detection device being arranged on a downstream side in the recording medium conveyance direction of the line recording head, wherein when the defective pixel detection device detects the defective pixel, the control device controls at least one of the recording head arrangement device and the shuttle-scan mechanism to restore the defective pixel by re-recording a pixel corresponding to the defective pixel using one of the recording elements different than another of the recording elements that has caused the defective pixel.

5. The image recording apparatus according to claim 1, wherein:

the recording head arrangement device turns and positions the line recording head so that the line recording head is in at least one of the orthogonal position, the inclined position, and a parallel position where the lengthwise direction of the line recording head is substantially parallel to the recording medium conveyance direction;

the image recording apparatus further comprises a shuttle-scan mechanism for performing shuttle-scanning which causes the line recording head positioned in the parallel position to move to shuttle-scan the recording medium in a direction substantially orthogonal to the recording medium conveyance direction while maintaining the line recording head in the parallel position; and when the width detection device detects that the width of the recording medium is greater than the effective recording width of the line recording head, the control device controls the recording head arrangement device to position the line recording head in the parallel position, and controls the line recording head, the recording medium conveyance device and the shuttle-scan mechanism to record an image onto the recording medium while performing the shuttle-scanning.

6. The image recording apparatus according to claim 5, further comprising a defective pixel detection device for detecting a defective pixel in the image having been recorded on the recording medium, the defective pixel detection device being arranged on a downstream side in the recording medium conveyance direction of the line recording head, wherein when the defective pixel detection device detects the defective pixel, the control device controls at least one of the recording head arrangement device and the shuttle-scan mechanism to restore the defective pixel by re-recording a pixel corresponding to the defective pixel using one of the recording elements different than another of the recording elements that has caused the defective pixel.

* * * * *